US005770049A

United States Patent [19]

Humphreys

[11] Patent Number: 5,770,049

[45] **Date of Patent: *Jun. 23, 1998**

[54] TAR SANDS EXTRACTION PROCESS

[75] Inventor: Reginald D. Humphreys, Edmonton, Canada

[73] Assignee: Geopetrol Equipment Ltd., Edmonton, Canada

[ * ] Notice: The term of this patent shall not extend beyond the expiration date of Pat. No. 5,626,743.

[21] Appl. No.: 719,513

[22] Filed: Sep. 25, 1996

[30] Foreign Application Priority Data

Feb. 5, 1996 [CA] Canada ..... 2168808

[51] Int. Cl.[6] ..... C10G 1/04

[52] U.S. Cl. ..... 208/391

[58] Field of Search ..... 208/391

[56] References Cited

U.S. PATENT DOCUMENTS 3,951,778 4/1976 Willard .
4,120,777 10/1978 Globus .
4,929,341 5/1990 Thirumalachar .
4,968,413 11/1990 Datta .
5,626,743 5/1997 Humphreys ..... 208/391

OTHER PUBLICATIONS

"Oil Sands Extraction: A Dynamic Technology" J.A. Stone et. al. 1989–1990 No Month Available.

"Alternative Bitumen Extraction Technologies For Mined Oil Sand" Dynawest Projects Ltd. 1982 (table of contents and Pertinent Sections) No Month Available.

*Primary Examiner*—Elizabeth D. Wood
*Attorney, Agent, or Firm*—Bennett Jones Verchere

[57] ABSTRACT

A hot water extraction process for extracting bitumen from tar sands is taught using a conditioning agent containing an alkali metal bicarbonate and an alkali metal carbonate. A source of calcium and/or magnesium ions can also be added. The conditioning agent replaces the caustic soda agent previously used in tar sand extraction. The use of the alkali metal bicarbonate and carbonate substantially eliminates the production of sludge in tar sand extraction and maintains or improves bitumen recovery. The process allows for hot conditioning agent solution to be recycled to the process by use of a recycle storage tank.

32 Claims, 3 Drawing Sheets

TAR SANDS EXTRACTION PROCESS

FIELD OF THE INVENTION

The present invention is directed toward a tar sands extraction process and, in particular, a hot water extraction process for tar sands and a conditioning agent for use therein.

BACKGROUND OF THE INVENTION

Throughout the world, considerable oil reserves are locked in the form of tar sands, also called bitumen sands. The hot water extraction process is the standard process for recovering bitumen from the sand and other material in which it is bound. The bitumen is then treated to obtain a synthetic crude oil therefrom.

In the hot water extraction process using existing extraction facilities, tar sand is first conditioned in large conditioning drums or tumblers with the addition of caustic soda (sodium hydroxide) and hot water at a temperature of about 180° F. The nature of these tumblers is well known in the art. The tumblers have means for steam injection and further have retarders, lifters and advancers which create violently turbulent flow and positive physical action to break up the tar sand and mix the resultant mixture vigorously to condition the tar sands. This causes the bitumen to be aerated and separated to form a froth.

The mixture from the tumblers is screened to separate the larger debris and is passed to a separating cell where settling time is provided to allow the aerated slurry to separate. As the mixture settles, the bitumen froth rises to the surface and the sand particles and sediments fall to the bottom to form a sediment layer. A middle viscous sludge layer, termed middlings, contains dispersed clay particles and some trapped bitumen which is not able to rise due to the viscosity of the sludge. The froth is skimmed off for froth treatment and the sediment layer is passed to a tailings pond. The middlings is often fed to a second stage of froth floatation for further bitumen froth recovery.

Recently, a modified hot water extraction process termed the hydrotransport system has been tested. In this system, the tar sand is mixed with hot water and caustic at the mine site and the resultant mixture is transported to the extraction unit in a large pipe. During the hydrotransport, the tar sand is violently mixed and aerated by turbulent flow and by injection of air at intermittent points along the pipe. As a result, the tar sand is conditioned and the bitumen is aerated to form a froth. This system replaces the manual or mechanical transport of the tar sands to the extraction unit and eliminates the need for tumblers.

The bitumen froth from either process contains bitumen, air, solids and trapped water. The solids which are present in the froth are in the form of clays, silt and some sand. From the separating cell the froth is passed to a defrother vessel where the froth is heated and broken to remove the air. Naphtha is then added to cause a reduction in the density of the bitumen, facilitating separation of the water and solids from the bitumen by means of a subsequent centrifuge treatment. The centrifuge treatment first includes a gross centrifuge separation followed by high speed centrifuge separations. The bitumen collected from the centrifuge treatment usually contains less than 2% water and solids and can be passed to the refinery for upgrading. The water and solids released during the centrifuge treatment are passed to the tailings pond.

The tailings in the tailing pond are largely a sludge of caustic soda, solids and water with some bitumen. During the initial years of residence time, some settling takes place in the upper layer of the pond, releasing some of the trapped water. The water released from the sludge can be recycled back into the hot water process. The major portion of the tailings remains as sludge indefinitely. The sludge contains some bitumen and high percentages of solids, mainly in the form of suspended silt and clay.

The tailings ponds are costly to build and maintain. The size of the ponds and their characteristic caustic condition creates serious environmental problems. In addition, environmental concerns exist over the large quantity of water which is required for extraction and which remains locked in the tailings pond after use.

It is known that sludge is formed in the initial conditioning of the tar sand, when the caustic soda attacks the silt and clay particles. The caustic soda causes the clays to swell and disburse into platelets. These platelets are held in suspension and form the gel-like sludge. Expanding-type clays such as the montmorillanite clays are particularly susceptible to caustic attack. Because of the problems caused by sludge formation and the low bitumen recovery available from highly viscous sludges, lower grade tar sands containing high levels of clays cannot be treated satisfactorily using the hot water extraction process.

The need exists for an extraction process which would result in a reduction or elimination of the production of sludge and therefore an increase in the water available for recycling. Any such process would also provide the possibility of increased bitumen recovery from medium and lower grade ores.

Also it is desirable that any tar sand extraction process should maintain or increase the present throughput possible by use of existing extraction processes and thereby not increase the cost of extraction. It is further desirable that a tar sand extraction process be of use in conventional extraction facilities. It is also desirable to eliminate the hazardous caustic used in today's commercial units.

Alternate processes, such as that described in U.S. Pat. No. 4,120,777, have been proposed which include the use of alternate conditioning agents such as soluble metal bicarbonates. However, such processes have generally not been adopted by the industry for a number of reasons. For example, proposed processes often increase the cost of extraction beyond reasonable levels by requiring the use of large amounts of agents or by reducing the rate at which tar sand can be processed. In addition, such processes are not readily adopted since they cannot be carried out in existing extraction facilities.

SUMMARY OF THE INVENTION

A process for tar sand extraction has been invented using a conditioning agent comprising an alkali metal bicarbonate and an alkali metal carbonate with or without a source of calcium and/or magnesium ions.

According to a broad aspect of the present invention, there is provided an aqueous tar sand conditioning agent solution for use in hot water extraction comprising: an alkali metal bicarbonate and an alkali metal carbonate.

According to a further broad aspect of the present invention, there is provided a process for extraction of bitumen from tar sands comprising:

providing a slurry comprising, the tar sand, hot water, an alkali metal bicarbonate and an alkali metal carbonate;

mixing and aerating the slurry to form a froth containing bitumen within the slurry; and, separating the froth from the slurry.

According to a further broad aspect of the present invention there is provided a process for removing bitumen from the surface of tar sand debris comprising: washing the debris with a high pressure spray of a solution comprised of hot water and a conditioning agent comprising an alkali metal bicarbonate and an alkali metal carbonate.

According to a further broad aspect of the invention, there is provided a process for using a hot water extraction apparatus having a transport pipe and a separation cell, the process comprising: mixing tar sand, hot water and a conditioning agent comprising an alkali metal bicarbonate and an alkali metal carbonate to form a slurry; moving the slurry along the transport pipe such that a froth containing bitumen is formed within the slurry; and separating the froth from the slurry in the separation cell.

According to a still further aspect of the present invention there is provided a process for using a hot water extraction apparatus having a slurry tumbler and a separation cell, the process comprising: in the tumbler, mixing and aerating a slurry comprising tar sand, hot water and a conditioning agent comprising an alkali metal bicarbonate and an alkali metal carbonate to form a slurry, such that a froth containing bitumen is formed within the slurry; passing the slurry to the separation cell; and separating the froth from the slurry in the separation cell.

Conditioning with the conditioning agent of the present invention allows a reduction in sludge production when compared to the present caustic in hot water extraction. The hot water extraction equipment presently in use can be used with the conditioning agent of the present invention in an improved hot water extraction process. The conditioning agent is also useful in modified hot water extraction equipment such as the hydrotransport system.

DETAILED DESCRIPTION OF THE INVENTION

A conditioning agent is used in an aqueous solution with hot water to condition the tar sand for quick release of the bitumen substantially without the production of waste sludge. The term waste sludge is used herein to define the sludge which is produced during the caustic/hot water extraction which will remain in a gel-like condition for many years. By use of the conditioning agent of the present invention in a hot water extraction process, a waste slurry is produced comprising some trapped bitumen, sand and silt in water containing the conditioning agent. This slurry will begin to settle immediately upon resting and will settle to form a sediment layer and supernatant water in a short period of time. The water containing conditioning agent can be recycled for use in the hot water extraction process.

In an embodiment, the conditioning agent of the present invention is comprised of an alkali metal bicarbonate and an alkali metal carbonate. Preferably, the alkali metal salts are sodium and/or potassium carbonate and sodium and/or potassium bicarbonate. Since, at present, the sodium salts are less expensive than the potassium salts, a conditioning agent comprising sodium bicarbonate and sodium carbonate is usually preferred to reduce the cost of an extraction process employing the conditioning agent.

The conditioning agent contains the carbonate salt and the bicarbonate salt in a ratio of from 95:5 to 5:95 (weight to weight). While the use of a conditioning agent having carbonate to bicarbonate ratios within this range will act to condition tar sands, preferably where the tar sand or water, or the mixture of the two, to be used in the extraction have a pH lower than between about 8.0 to 8.5, the amount of carbonate can be increased relative to the amount of bicarbonate and where the water to be used has a pH higher than between about 8.0 to 8.5, the amount of carbonate can be reduced relative to the amount of bicarbonate. As an example, recycle water from previous caustic extractions has a high pH. When this recycle water, having a high pH, is used for extraction according to the present invention, the ratio of carbonate to bicarbonate is preferably 20:80 by weight.

While lower concentrations will act to condition tar sands, an addition of sodium and/or potassium bicarbonate in combination with sodium and/or potassium carbonate in an amount of at least about 0.012% by weight of water represents a lower useful concentration since the addition of amounts below about 0.012% by weight reduce the effectiveness of the conditioning so that less satisfactory extraction occurs, in terms of economics. The upper levels of amounts of combined carbonate and bicarbonate added to the extraction also depend upon economics. The cost of the additional agent must be weighed against the improvement in the level of conditioning and bitumen recovery. Generally, it has been found that the addition of amounts above 0.5% increase the cost of the process above reasonable levels, without greatly affecting the level of conditioning. Preferably, the sodium and/or potassium bicarbonates and carbonates are added in a total amount of about 0.03% by weight of water. Preferably, the conditioning agent/hot water solution is added to the tar sand such that a consistency is obtained which will allow suitable mixing and froth floatation, such as, for example a solution to tar sand ratio of 0.5:1 to 5:1 by weight and preferably 1:1 to 1.5:1. The addition of the conditioning agent/hot water solution to the tar sands allows the conditioning to begin immediately.

Alternately, the conditioning agent may be added directly to the tar sand or to a tar sand and water mixture. Regardless of the method of addition of the conditioning agent, the conditioning agent is preferably added to the slurry comprising tar sand, water and conditioning agent, in an amount of generally at least about 0.004% to 0.42% by weight of slurry and preferably about 0.015% by weight of the slurry.

Any source of water can be used in the extraction process. Normally, the water source will be surface water, such as water from nearby lakes or river, or recycle water from the previous extraction processes. It has been found that recycle water from tailings ponds which have previously stored caustic tailings can also be used with the conditioning agent of the present invention to condition tar sands. Sometimes recycle water is used in combination with surface water.

It has been found that a total concentration of at least about 50 ppm of calcium and/or magnesium ions in the water used in the extraction process enhances the settling. While concentrations above about 50 ppm will act to enhance settling, concentrations above 200 ppm are preferred. The upper levels of useful calcium and/or magnesium ion concentrations depend upon economics. The cost of increasing the total ion concentration must be weighed against the improvement in the rate of settling. Generally it has been found that concentrations above about 600 ppm increase the cost of the process, without greatly affecting the rate of settling. Preferably, water for use in the extraction process is monitored to ensure sufficient concentrations of calcium and/or magnesium ions are present.

Since the recycle water used in hot water extraction does not normally contain the desired concentrations of calcium and/or magnesium ions, in another embodiment the conditioning agent comprises sodium and/or potassium bicarbonate, in combination with sodium and/or potassium carbonate and effective concentrations of a source of calcium and/or magnesium ions. Sources of the ions are soluble calcium and/or magnesium salts which are suitable for use in the medium, such as gypsum. The conditioning agent is used such that the sodium and/or potassium bicarbonate in combination with sodium and/or potassium carbonate are added in a total amount of at least about 0.004% by weight of slurry and the total concentration of calcium and/or magnesium ions in solution is at least about 50 ppm.

Where greater control over the concentrations of each of the carbonate and bicarbonate ions and calcium and/or magnesium ions is required, the concentrations of each of these ions can be modified separately such as by separate addition of sodium or potassium bicarbonates or carbonates and sources of calcium and/or magnesium ions or solutions thereof to the slurry.

To effect conditioning of tar sands, the conditioning agent is preferably used with hot water at a temperature of between about 100° F. and 195° F., and most preferably 180° F.

It has been found that the use of wetting agents, detergents or emulsifiers in the conditioning process inhibits the settling of the waste slurry and recovery of bitumen. Thus, such additives should not be present for optimum results although small concentrations can be tolerated.

The conditioning agent can be added to the tar sand in solid form or as a solution and the hot water extraction process can proceed using traditional or modified processes, without the addition of caustic. Existing extraction facilities having tumblers, or hydro transport pipes and settling tanks can be used. New small tailings settling sites can be constructed or existing tailing ponds can be used.

Once extraction has taken place, the solution of conditioning agent in water is present in the slurry which is sent to the tailings ponds. The conditioning agent solution is freed within a few days, upon settling of the slurry. A portion of the solution will be trapped in the interstitial spaces of the settled sand and clay mixture in the pond.

In one embodiment which allows for recycling of conditioning agent solution to the process prior to complete cooling of the solution, the mid cell layer resulting from separation is recycled prior to passage to the tailings pond. Such recycle can be carried out in various ways, depending upon the degree of settling obtained during froth floatation and separation. The degree of settling is dependent on the residence time in the separation cell or cells and the grade of the tar sand treated. To provide for such recycling, in one embodiment, at least one recycle storage tank is provided which allows for settling of the mid cell layer without the use of the tailings ponds. The tank is used to store the mid cell layer from the separation step for a period of time which is only sufficient for settling to obtain conditioning solution which is suitable for recycle, but not sufficient for complete cooling of the conditioning solution. For example, the tank is preferably sized to accommodate several hours of throughput. The tank is preferably formed of carbon steel and is enclosed and insulated by any suitable insulating material, with consideration as to the temperature of liquid to be stored in the tanks. Alternately, where sufficient settling has occurred during residence time in the separation process, the conditioning solution is recycled directly to the process after removal from the separation tank. Lines carrying the recycle solution are preferably insulated to reduce heat transfer out of the recycle solution during transport. To enhance the conservation of heat energy in the recycle liquid, the entire tar sands apparatus including the tumblers or hydrotransport lines, separation cells and any lines extending therebetween can be insulated to reduce heat loss therethrough.

In an embodiment incorporating a single recycle tank, the mid cell layer is fed to the middle of the tank at a flow rate which does not create turbulence. Recycle liquid is drawn from the upper regions of the tank where sufficient settling has occurred. In an alternate embodiment, two or more tanks are provided such that each tank is filled in turn and time for settling is provided while the others are being filled. Recycle liquids are drawn from the tanks in which sufficient settling has occurred.

Sediments which accumulate in the storage tanks are periodically passed to the tailings pond where any remaining conditioning agent solution is freed within a few days, upon settling of the sediments. Preferably, the tanks are formed with a generally conical lower portion having a valve at the lower limit thereof to facilitate the removal of sediments.

The conditioning agent can be used as a solution in hot water to wash oversize debris obtained by screening the slurry prior to entry into the settling tanks. Such chunks of debris contain bitumen on their surface which can be recovered by high pressure washing with the conditioning agent/hot water solution described hereinbefore. Recycle water, heated to about 100° F.–195° F. can also be used to recover the bitumen. The resultant wash water containing bitumen is sent to the separation cell for bitumen recovery.

BRIEF DESCRIPTION OF THE DRAWINGS

A further detailed, description of the invention will follow by reference to the following drawings of specific embodiments of the invention, which depict only typical embodiments of the invention and are therefore not to be considered limiting of its scope.

DETAILED DESCRIPTION OF THE PREFERRED EMBODIMENTS

Figure 1:
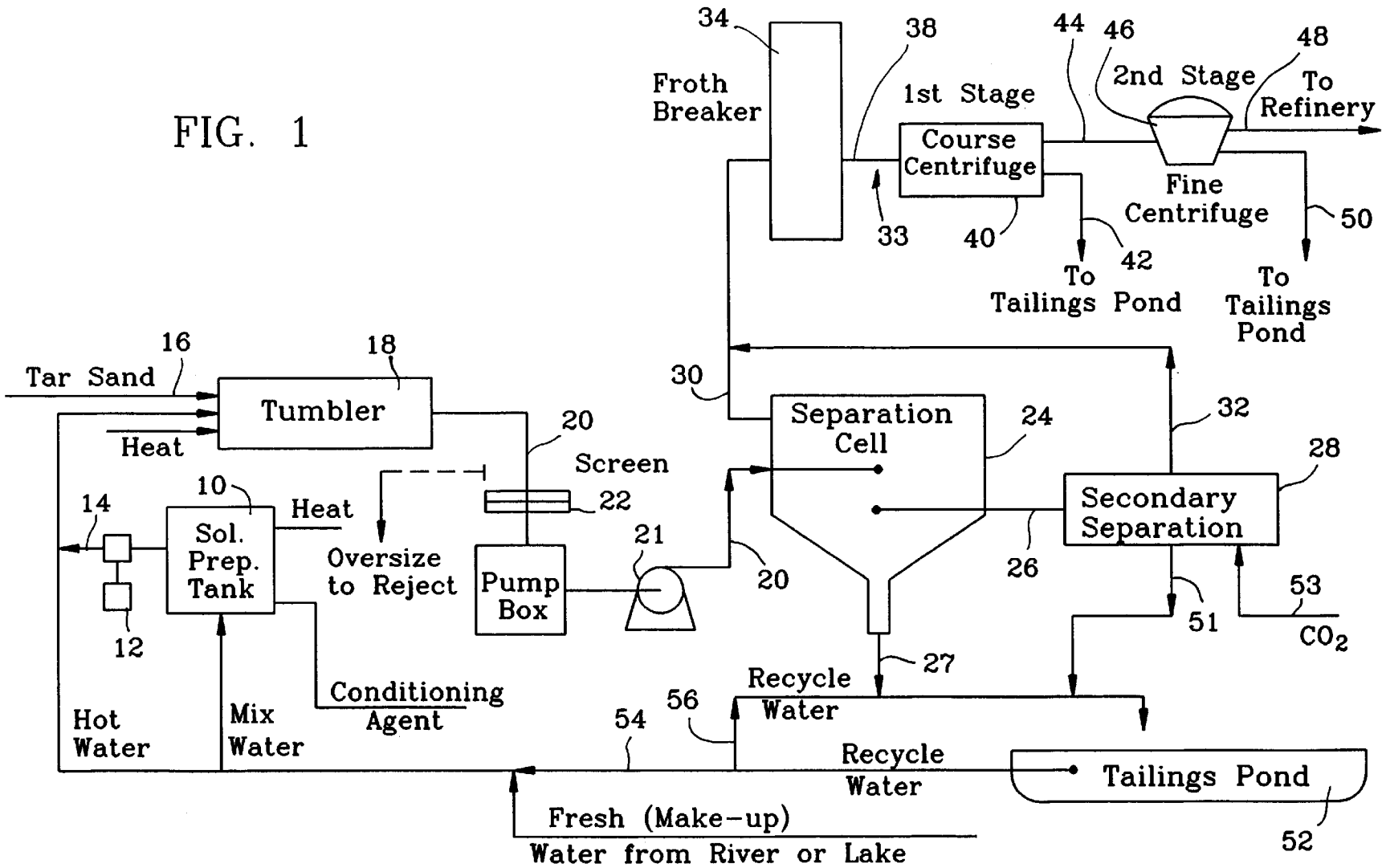
FIG. 1 is a schematic flow diagram of a hot water extraction process of the present invention.

Referring to FIG. 1, a flow diagram is shown depicting a hot water extraction process incorporating the conditioning agent of the present invention. The process can be carried out using conventional extraction facilities as are known and are as described hereinbefore. Water for use in the process is obtained from surface water sources such as nearby lakes or rivers or recycled from tailings ponds. A combination of water sources can also be utilized, as is shown.

Conditioning agent comprising, in the preferred embodiment, sodium and/or potassium bicarbonate in combination with sodium or potassium carbonate in a ratio of from 95:5 to 5:95, the ratio being preferably selected as discussed hereinbefore with regard to the pH of the water to be used in the extraction, and soluble calcium and/or magnesium salts, such as gypsum, are mixed with water from line 54 in a solution preparation tank 10 to form a concentrated conditioning agent solution. The concentrated conditioning solution is passed via a line 14 through proportioning pump 12 which acts to measure the required volume of conditioning solution necessary to add the desired amount of the conditioning agent to the water, such as, for example a total amount of sodium or potassium bicarbonate and carbonate of about 0.03% by weight water and at least 50 ppm calcium and/or magnesium ions. In a preferred embodiment, where water from previous tar sand extraction processes in which only the present conditioning agent was used, an amount of surface water is added to make-up for the amount of water lost in previous extractions (i.e. in the interstitial spaces of the settled sand and clay) and the amount of concentrated conditioning agent added is preferably reduced to a minimum, for example 0.012% by weight of water. The volume of concentrated conditioning solution as proportioned by pump 12 then continues via line 14 to be added to water passing in line 54. Preferably, the water in line 54 and any additives which are added to the water, such as the conditioning agent solution in tank 10, are heated to a temperature of about 180° F. for use in the process.

The prepared solution continues along line 54 and is fed to tumbler 18 where it is mixed with tar sand, entering on conveyor 16, to form a slurry. Tumbler 18 causes the slurry to be aerated and mixed vigorously by means of steam injection and positive physical action, causing the bitumen to be stripped from the sand grains. A bitumen froth is formed by aeration of the bitumen during tumbling. The residence time of the slurry in the tumbling drum is not critical, but should preferably be maintained at as low a level as reasonably possible to optimize throughput. The preferred residence time for any installation and tar sand quality can be determined by gradually increasing or decreasing residence time while noting the amount of oil recovered. This can be plotted to show what increase occurs with increased residence, and the value of the increased recovery can be plotted against the cost of increased recovery to find an economically useful residence time. As an example, using residence times which are presently used in large scale tar sand extraction, the slurry is treated in the tumbling drums for about 24 to 27 minutes. The residence time is increased, such as, for example to 26 to 29 minutes, where the tar sand is in the form of large lumps.

After tumbling, the slurry is passed via line 20 through screen 22 which removes larger debris. Line 20 continues through a pump 21 to separation cell 24 where settling time is provided to allow the slurry to separate into layers comprising froth, a mid cell layer and sediments. According to accepted tar sand extraction processes, suitable separation is provided by a residence time of 25 to 28 minutes. However, this residence time is not critical to the invention and can be adjusted on a cost-benefit analysis.

Sediments, including sand and silts, and water from the separation cell are passed through line 27 to a tailings pond 52.

The mid cell layer, unlike the middlings produced by the traditional caustic hot water process, is not a stable sludge and requires considerably less time to settle than the caustic process middlings. A secondary separation cell 28 is, thus, not critical but such cells exist in conventional separation apparatus and can be used to advantage. Accordingly, after a shorter residence time in separation cell 24 (for example 18 to 20 minutes) and removal of any froth, a greater flow of mid cell layer, including the unsettled and a portion of the settled sediments from cell 24 can be fed via line 26 to secondary separation cell 28 which will act as an extension of separation cell 24 and will allow greater throughput in the system. In secondary separation cell 28, the mid cell layer is re-aerated or bubbled with carbon dioxide entering through line 53 to form a froth with residence time for separation.

The residence times listed in the preferred embodiment correspond with residence times presently in use in existing facilities. Since suitable concentrations of bicarbonate and carbonate ions and calcium and/or magnesium ions, in the extraction process enhance the settling of the slurry and the recovery of bitumen, it is believed that residence times in the tumbler and separation cells can be reduced by use of the process of the present invention thereby enhancing throughput in extraction facilities. However, it is to be understood that residence times are not critical to the invention and should be optimized by cost benefit analysis.

Froth resulting from separation cell 24 and secondary separation cell 28 is fed via lines 30 and 32, respectively, to a conventional froth breaker vessel 34.

In vessel 34, the froth is heated and broken. A diluting agent such as naphtha is added to the broken froth as by line 33. The resultant mixture is fed via line 38 to coarse centrifuge 40 where the bitumen is separated from the heavier solids and the bulk of the water.

The partially cleaned bitumen recovered from centrifuge 40 is sent via line 44 to fine centrifuge 46 for further cleaning and then to refinery storage for future upgrading.

Sediments and conditioning solution from the bottom of separation cell 24, secondary separation cell 28 and centrifuges 40 and 46 are fed via lines 27, 42, 50, and 51 to tailings pond 52 where settling occurs and water containing conditioning agent is released. The released liquid has been found to contain only slightly less conditioning agent than the initially introduced concentration and can be recycled back via line 54 for use in the initial conditioning of tar sand. In addition, recycle water can be fed via line 56 to the outlet 27 of separation cell 24, and the outlet 51 of secondary separation cell 28 to assist in the passage of sediments to the tailings pond 52. Additional use can be made of the released liquid for washing of oversize debris, as will be discussed in more detail below.

Figure 2:
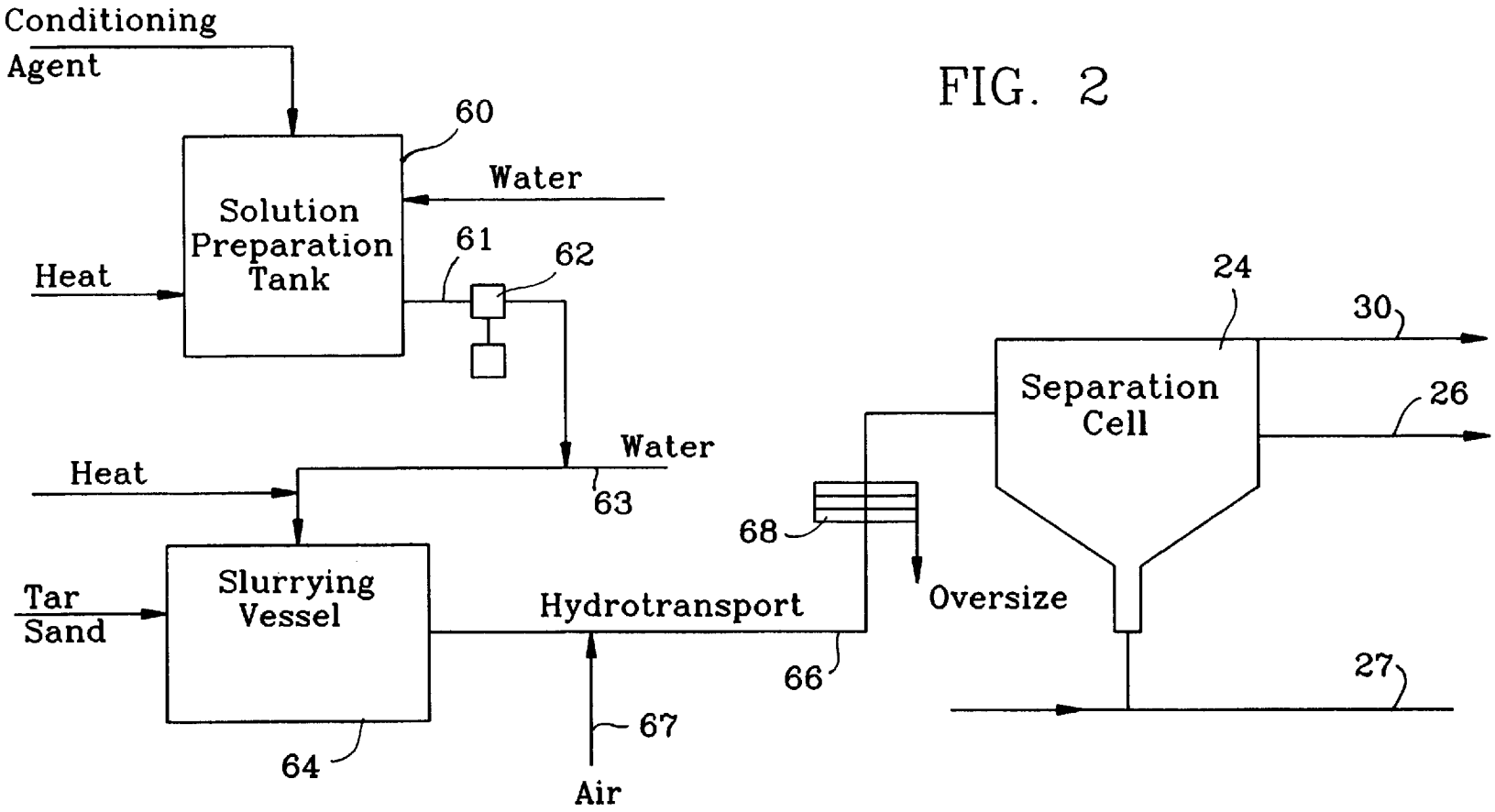
FIG. 2 is a schematic flow diagram of an alternative hot water extraction process of the present invention; and, FIG. 3 is a schematic flow diagram of another hot water extraction process of the present invention.

Referring to FIG. 2, a flow diagram is shown depicting an alternate hot water extraction process incorporating the conditioning agent of the present invention in equipment designed for the hydrotransport system. Conditioning agent and water are mixed in solution preparation tank 60. As discussed with reference to FIG. 1, water for use in the preparation of the concentrated conditioning solution and for mixing with the tar sand can be surface water and/or recycle water. The concentrated conditioning solution is passed via a line 61 through proportioning pump 62 for mixing with water passing via line 63 to form a conditioning solution of desired concentration. The conditioning solution passes into slurrying vessel 64 where it is mixed with tar sand to form a slurry. Vessel 64 is located at the mine site. The production of a slurry at the mine site allows for the transport of the slurry to the separation facility through a transport pipe 66. Thus, the need for transporting the tar sand, by means of trucking or conveyor systems, is avoided. Pipe 66 provides vigourous mixing of the slurry during transport, causing the bitumen to be stripped from the sand particles. Aeration can be provided along transport pipe 66, as shown at 67, and other points to assist in the conditioning of the tar sand and the formation of bitumen froth. The residence time in pipe 66 is dependent on the distance to be travelled. From pipe 66 the slurry is passed through screen 68 and on to separation cell 24 for further treatment as is described above in reference to FIG. 1.

Figure 3:
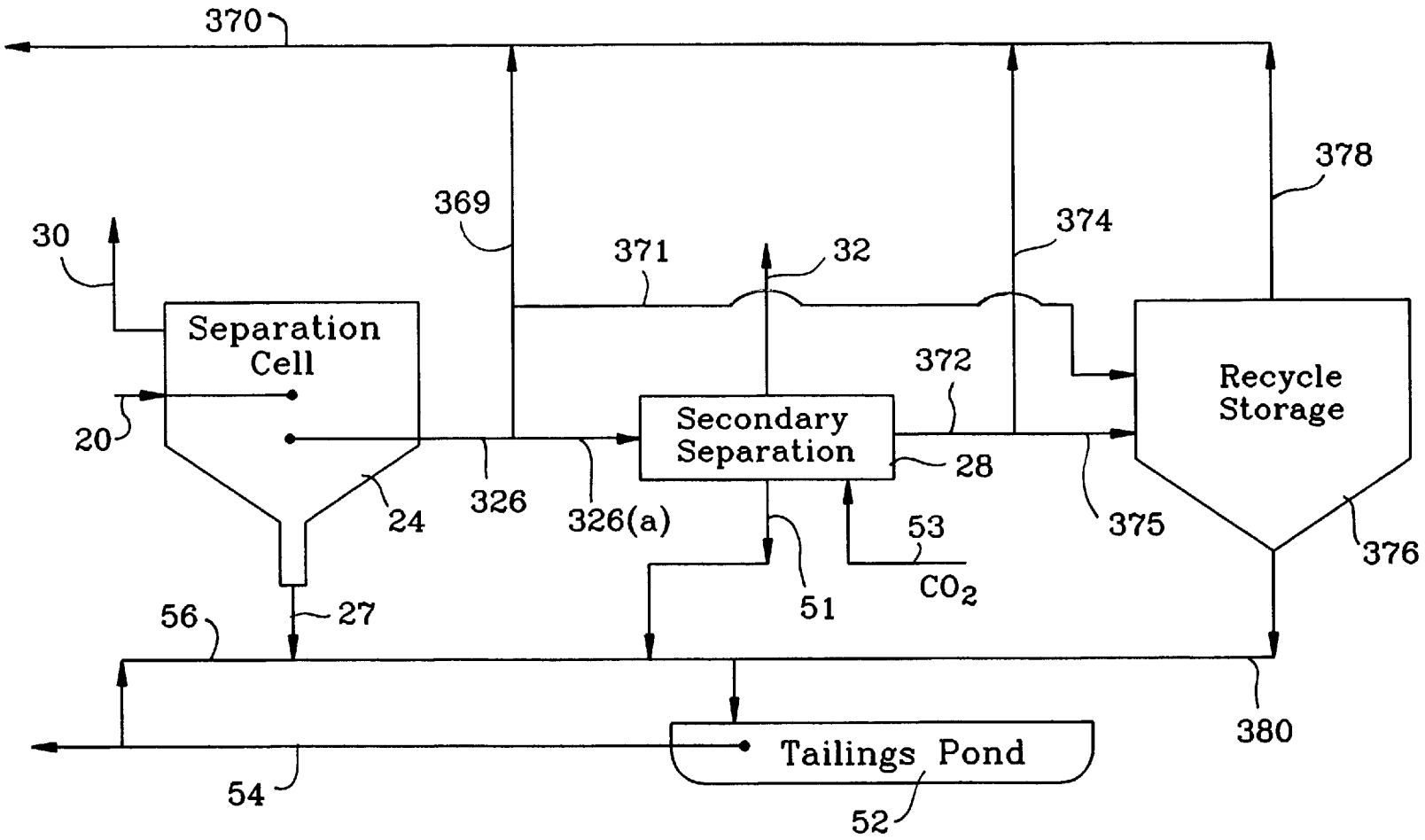

Referring to FIG. 3, there is shown another embodiment of a hot water extraction process of the present invention using direct recycling of conditioning solution prior to cooling of the solution. In such a process various recycling paths can be taken depending on the level of settling provided by residence times in the separation cell or cells. As discussed with reference to FIGS. 1 and 2, a slurry which has been conditioned by use of the present conditioning agent is fed via line 20 to separation cell 24 for froth floatation. Froth recovered in separation cell 24 is fed via line 30 for further treatment, as discussed in reference to FIG. 1. The remaining mid cell layer and sediments are treated according to the desired extraction process and the degree of the settling achieved by residence time in separation cell 24.

If secondary separation is not used and sufficient settling has occurred so that the mid cell layer comprises conditioning solution suitable for recycle, the mid cell layer is recycled via lines 326, 369 and 370 for use in conditioning of further tar sands and the bulk of the sand and clay in separation cell 24 is passed via lines 27 and 56 to tailings pond 52. Alternately, if the secondary separation is not used, but sufficient settling has not occurred, the mid cell layer from cell 24 can be passed via lines 326, 369 and 371 to a recycle storage tank 376 for provision of residence time for settling of any remaining sediments.

If either insufficient settling has occurred in separation cell 24 or if it is desired that a secondary separation be used for further froth recovery, a greater flow of mid cell layer from separation cell 24, including a portion of the settled sediments, is passed from cell 24 via lines 326 and 326*a* to secondary separation cell 28. After re-aeration or carbon dioxide bubbling of the mid cell layer in cell 28, residence time is provided for settling. Froth from cell 28 is fed via line 32 for further treatment, as discussed in reference to FIG. 1. The remaining mid cell layer and sediments are treated according to the level of settling obtained during residence time. If sufficient settling has occurred such that the mid cell layer comprises conditioning solution suitable for recycle, the mid cell layer is recycled via lines 370, 372 and 374 for use in conditioning of further tar sands and any remaining sediments in separation cell 28 are passed via lines 51 and 56 to tailings pond 52. If insufficient settling has occurred in secondary separation cell 28, the mid cell layer from cell 28, is passed via line 372 and 375 to tank 376 where residence time is provided for settling of sediments from the conditioning solution. After sufficient residence time is provided, the conditioning solution is recycled via lines 378 and 370 for use in conditioning of further tar sands. Sediments from tank 376 are passed via lines 380 and 56 to tailings pond 52 by flushing with a small amount of conditioning solution. Tank 376 and lines 20, 326, 326*a*, 369, 370, 371, 372, 374, 375 and 378 are each insulated to reduce the transfer of heat energy from the conditioning solution.

In a preferred embodiment, tank 376 is an enclosed tank suitably sized to accommodate several hours of throughput. Input is fed to a middle region of the tank and recycle liquid is taken from the upper regions of the tank. In an alternate embodiment (not shown), two substantially identical tanks are used. In such an embodiment, the mid cell layer flow is directed to one of the tanks until it is filled. The filled tank is then given time to settle and recycle supply is taken from this tank while the second tank is being filled. The two tanks continue being alternately filled and emptied. Periodically, accumulated sediments are flushed from the tanks to the tailings pond.

The embodiments of the recycle lines from the primary and secondary separation cells and the insulated tank need not all be present in the same tar sand extraction facility as the presence of one or more of the lines or tank may not be required for the particular extraction being undertaken, depending on the residence times in the separation cells and the grade of tar sand which is treated. Alternately, the recycle lines and storage tank can all be present at all times and used as needed.

The conditioning agent can also be used as a solution in hot water of about 100° F.–195° F. to wash oversize debris obtained by screening the slurry prior to entry into the slurrying vessel 64 (FIG. 2) or separation cell 24. Such debris contains bitumen on its surface which can be recovered by high pressure washing with the conditioning agent/hot water solution described hereinbefore. Recycle water containing conditioning agent at an amount of at least 0.012% by weight, heated to 100° F.–195° F. can also be used to recover the bitumen. The action of the high pressure conditioning wash causes the bitumen to be stripped and aerated to form a forth. The wash water containing the bitumen froth is fed to a separation cell for bitumen recovery.

The invention will be further illustrated by the following examples. While the examples illustrate the invention, they are not intended to limit the scope of the invention.

EXAMPLE I

Many conditioning agents and combinations thereof were used in testing both medium and low grade tar sands. The following table shows the percentage recoveries and settling rates for seven conditioning solutions.

The seven conditioning solutions were prepared as follows:

Solution I was prepared by addition of sodium bicarbonate to water in an amount of 0.5% by weight of water.

Solution II was prepared by addition of potassium bicarbonate to water in an amount of 0.5% by weight of water.

Solution III was prepared by addition of a mixture of 1:1 parts by weight of sodium bicarbonate and potassium bicarbonate to water in an amount of 0.5% by weight of water.

Solution IV was prepared by addition of sodium hydroxide to water to obtain pH=9.

Solution V was prepared by addition of a mixture containing 8:2 parts by weight of sodium bicarbonate and sodium carbonate to water in an amount of 0.02% by weight of water.

Solution VI was prepared by addition of a mixture containing 8:2 parts by weight of sodium bicarbonate and sodium carbonate to water in an amount of 0.02% by weight of water and addition of gypsum in an amount of 0.06% by weight of water.

Separate extractions are carried out using Solutions I to VI in a laboratory batch extraction unit (BEU) for use in comparison of hot water extraction methods. The experimental method varies slightly from that in use in large scale extraction by addition of an initial mixing step. This step is carried out in the BEU which is not carried out in large scale processes because the BEU is not capable of providing the degree of mixing which is provided by large scale tumblers.

A BEU is charged with 150 ml of a selected conditioning solution at a temperature of 180° F. and 500 g of medium or low grade tar sand, as indicated, and an initial mixing is carried out. A further 1000 ml of selected conditioning solution at a temperature of 180° F. is charged to the BEU. The contents of the BEU are mixed and aerated for 10 minutes. After mixing, all aeration and agitation is ceased and the primary froth is removed. The procedure is repeated for 5 minutes and the secondary froth is removed.

Samples of mid cell layers (water layers) are taken at regular times as indicated in Table I. All solids content values are expressed as a percent solids per volume as determined by centrifuging. Percent recovery is determined using laboratory analysis to determine bitumen content in both untreated sand and bitumen froth.

TABLE I

| Conditioning Solution | Percent Recovery | Percent Solids After 20 min. | 40 min. | 60 min. | 1 day | 2 days |
|---|---|---|---|---|---|---|
| Solution I (both grades) | 96.8 to 100 | 0.93 to 0.53 | 0.87 to 0.47 | 0.75 to 0.45 | 0.35 to 0.31 | trace |
| Solution II (both grades) | 96.5 to 99.0 | 0.83 to 0.46 | 0.79 to 0.49 | 0.78 to 0.50 | 0.33 to 0.34 | 0 |
| Solution III (both grades) | 96.8 to 99.0 | 1.18 to 0.82 | 1.0 to 0.0 | 0.69 to 0.65 | 0.33 to 0.20 | 0 |
| Solution IV (medium grade) | 95.1 to 98.7 | 7.7 to 11.5 | 6.4 to 11.5 | 3.7 to 11.5 | 1.6 to 11.5 | 0.7 to 11.5 |
| Solution IV (low grade) | 84.9 to 97.2 | 1.3 to 28.0 | 1.0 to 28.0 | 0.7 to 28.0 | trace to 28.0 | trace to 28.0 |
| Solution V (both grades) | 99.0 to 99.8 | 0.6 to 0.4 | trace | 0 | 0 | 0 |
| Solution VI (both grades) | 99.0 to 99.9 | 0.5 to 0.3 | trace | 0 | 0 | 0 |

Bitumen recoveries for both low and medium grade tar sands were consistently between 99.0 and 99.8% when using mixtures of sodium carbonate and sodium bicarbonate (Solutions V and VI). Although the results are not shown, similar results were obtained using mixtures of potassium carbonate and bicarbonate and mixtures of sodium and/or potassium carbonates and bicarbonates. The recoveries and settling rates obtained by using the conditioning solution of the present invention are greatly improved over the results of caustic conditioning using Solution IV.

The addition of calcium and/or magnesium ions to the sodium bicarbonate and sodium carbonate conditioning was observed to enhance the settling rate, especially in the first few minutes after resting.

It will be apparent that many other changes may be made to the illustrative embodiments, while falling within the scope of the invention and it is intended that all such changes be covered by the claims appended hereto.

I claim:

1. A process for extraction of bitumen from tar sands comprising:

providing a slurry comprising, the tar sand, hot water and a conditioning agent including an alkali metal bicarbonate and an alkali metal carbonate in a ratio of from 95:5 to 5:95, weight by weight, the concentration of conditioning agent in the slurry being between about 0.004% to 0.42%, by weight of slurry;

mixing and aerating the slurry to form a froth containing bitumen within the slurry; and, separating the froth from the slurry.

2. The process as defined in claim 1 wherein the alkali metal bicarbonate is selected from the group consisting of sodium bicarbonate and potassium bicarbonate and the alkali metal carbonate is selected from the group consisting of sodium carbonate and potassium carbonate.

3. The process as defined in claim 1 wherein the hot water is at a temperature of between about 100° F.–195° F.

4. The process as defined in claim 1 wherein the slurry further comprises a total concentration of at least about 50 ppm of calcium and/or magnesium ions.

5. The process as defined in claim 1 wherein the hot water comprises recycled water from a tailings pond.

6. The process as defined in claim 1 wherein the hot water comprises recycled water from a recycle storage tank.

7. The process as defined in claim 5 wherein the recycled water contains residual caustic soda.

8. The process as defined in claim 1 wherein after separating the froth from the slurry, the process further comprises:

re-aerating the slurry to form additional froth containing bitumen and separating the additional froth from the slurry.

9. The process as defined in claim 1 wherein after separating the froth from the slurry, the process further comprises:

recycling at least a portion of the hot water and conditioning agent for use in further extraction of bitumen from tar sand.

10. The process as defined in claim 8 wherein after separating the additional froth from the slurry, the process further comprises:

recycling at least a portion of the hot water and conditioning agent for use in further extraction of bitumen from tar sand.

11. The process as defined in claim 1 wherein after separating the froth from the slurry, the process further comprises:

bubbling the slurry with carbon dioxide to form additional froth containing bitumen and separating the additional froth from the slurry.

12. The process as defined in claim 11 wherein after separating the additional froth from the slurry, the process further comprises:

recycling at least a portion of the hot water and conditioning agent for use in further extraction of bitumen from tar sand.

13. The process as defined in claim 1 wherein the step of mixing is carried out in a tumbler.

14. The process as defined in claim 1 wherein the step of mixing is carried out in a transport pipe.

15. The process as defined in claim 1 wherein the water for use in the process is monitored to determine its total concentration of calcium and/or magnesium ions, a source of calcium and/or magnesium ions being added to the water to increase the total concentration to 50 ppm where the total concentration is found not to be 50 ppm.

16. The process as defined in claim 1 wherein a suitable amount of a source of calcium and/or magnesium ions is added to the slurry such that a total concentration of calcium and/or magnesium ions is increased by at least about 50 ppm.

17. The process as defined in claim 4 wherein the ions are present at a total concentration of 50 ppm to 600 ppm.

18. The process as defined in claim 1 wherein the slurry contains one weight of tar sand to each weight of water.

19. A process for using a hot water extraction apparatus having a transport pipe and a separation cell, the process comprising:

mixing tar sand, hot water and a conditioning agent including an alkali metal bicarbonate and an alkali metal carbonate in a ratio of from 95:5 to 5:95, weight by weight, to form a slurry, the concentration of conditioning agent in the slurry being between about 0.004% to 0.42%, by weight of slurry;

moving the slurry along the transport pipe such that a froth containing bitumen is formed within the slurry;

separating the froth from the slurry in the separation cell.

20. The process as defined in claim 19 wherein the alkali metal bicarbonate is selected from the group consisting of sodium bicarbonate and potassium bicarbonate and the alkali metal carbonate is selected from the group consisting of sodium carbonate and potassium carbonate.

21. The process of claim 20 providing a recycle storage tank and passing the slurry to the recycle storage tank and providing for settling of the slurry to form sediments and a solution of the hot water and conditioning agent and recycling at least a portion of the solution from the recycle storage tank for use in mixing with further tar sand.

22. A process for using a hot water extraction apparatus having a slurry tumbler and a separation cell, the process comprising:

in the tumbler, providing a slurry comprising tar sand, hot water and a conditioning agent including an alkali metal bicarbonate and an alkali metal carbonate in a ratio of from 95:5 to 5:95, weight by weight, the concentration of conditioning agent in the slurry being between about 0.004% to 0.42%, by weight of slurry;

mixing and aerating the slurry such that a froth containing bitumen is formed within the slurry;

passing the slurry to the separation cell and separating the froth from the slurry in the separation cell.

23. The process as defined in claim 22 wherein the alkali metal bicarbonate is selected from the group consisting of sodium bicarbonate and potassium bicarbonate and the alkali metal carbonate is selected from the group consisting of sodium carbonate and potassium carbonate.

24. The process of claim 23 providing a recycle storage tank and passing the slurry to the recycle storage tank and providing for settling of the slurry to form sediments and a solution of the hot water and conditioning agent and recycling at least a portion of the solution from the recycle storage tank for use in mixing with further tar sand.

25. A process for removing bitumen from the surface of tar sand debris comprising:

washing the debris with a high pressure spray of a solution comprised of hot water and about 0.012% to 0.5% by weight water of a conditioning agent including an alkali metal bicarbonate and an alkali metal carbonate in a ratio of from 95:5 to 5:95, weight by weight.

26. The process as defined in claim 25 wherein the alkali metal bicarbonate is selected from the group consisting of sodium bicarbonate and potassium bicarbonate and the alkali metal carbonate is selected from the group consisting of sodium carbonate and potassium carbonate.

27. The process as defined in claim 26 wherein the hot water is at a temperature of between about 100° and 195° F.

28. The process as defined in claim 26 wherein the solution further comprises at least 50 ppm of calcium and/or magnesium ions.

29. A process for extraction of bitumen from tar sands comprising:

providing a slurry comprising, the tar sand, hot water and a conditioning agent including between about 5 to 96 parts by weight of at east one of sodium bicarbonate and potassium bicarbonate and between about 5 to 95 parts by weight of at least one of sodium carbonate and potassium carbonate, the conditioning agent being added in an amount of at least about 0.012% by weight water;

mixing and aerating the slurry to form a froth containing bitumen within the slurry; and, separating the froth from the slurry.

30. The process as defined in claim 1 wherein the slurry includes the water and the tar sand in a ratio of 0.5:1 to 5.0:1, by weight.

31. The process as defined in claim 29 wherein the slurry includes the water and the tar sand in a ratio of 0.5:1 to 5.0:1, by weight.

32. The process as defined in claim 29 wherein the slurry further comprises a total concentration of at least about 50 ppm of calcium and/or magnesium ions.

* * * * *